US006371404B1

(12) United States Patent
Christopherson et al.

(10) Patent No.: US 6,371,404 B1
(45) Date of Patent: Apr. 16, 2002

(54) INTERLOCKING BOBBIN HALVES

(75) Inventors: David Christopherson, Raleigh; Barry Powell, Knightdale; Towfig Gangjee, Raleigh, all of NC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/643,624

(22) Filed: Aug. 22, 2000

(51) Int. Cl.[7] ..... B65H 75/14; B65H 54/68; B21F 3/10

(52) U.S. Cl. ..... 242/608.6; 242/437.4; 242/472.7; 242/613.3

(58) Field of Search ..... 242/118.4, 613.2, 242/613.3, 608.6, 609.1, 472.7, 473.4, 473.3

(56) References Cited

U.S. PATENT DOCUMENTS 3,717,315 A * 2/1973 Kovaleski ..... 242/609.1
4,387,863 A * 6/1983 Edmonston et al. ..... 242/118.4
4,406,422 A * 9/1983 Philips ..... 242/118.4
4,867,391 A * 9/1989 Resch ..... 242/609.1 X
4,997,142 A * 3/1991 Grant ..... 242/118.4
5,464,171 A * 11/1995 Ripplinger ..... 242/609.1
5,531,399 A * 7/1996 Weisburn et al. ..... 242/608.6

* cited by examiner

*Primary Examiner*—Michael R. Mansen
(74) *Attorney, Agent, or Firm*—David R. Stacey; Larry T. Shrout; Larry I. Golden

(57) ABSTRACT

A bobbin for an electrical coil having a width that is small with respect to its depth. The bobbin is constructed from two identical halves, each having one generally flat flange and a web portion defining a latching feature, a locking feature and a core window centrally located in the flange. The mating surfaces of the two bobbin halves are defined along the distal ends of the web portions such that each half includes one complete flange and core window. The mating surfaces are also configured such as to prevent the fine coil wire from slipping between the mating surfaces of the two bobbin halves as the coil is being wound. The latching features of one bobbin half slidingly engage the latching features of the other bobbin half such that the two bobbin halves are held together. The locking features of the two bobbin halves also engage to prevent unintentional longitudinal movement between the two bobbin halves prior to winding the coil wire on the bobbin. The latching features are configured such that winding of the coil wire about the bobbin web positively interlocks the latches, thereby preventing them from being separated.

20 Claims, 6 Drawing Sheets

INTERLOCKING BOBBIN HALVES

FIELD OF THE INVENTION

The present invention relates to the field of electrical coils, and particularly to a bobbin on which an electrical coil is wound.

BACKGROUND OF THE INVENTION

It is common to wind coils of various shapes and sizes on mandrels (free form winding) or on bobbins. Coils wound on mandrels are generally taped after winding to maintain their shape while a bobbin provides structural support during the winding process and maintains the coil shape after winding. However, certain physical characteristics of a coil can make winding and maintaining the coil shape very difficult. The shape of any free form wound coil that has a small width with respect to depth will be very difficult to maintain during the winding process and after taping. If the coil's depth to width ratio is greater than about 2:1 and the width of the coil is less than about ⅜ inch, it is extremely difficult, if not impossible, to mold a useable bobbin for the coil. The flanges of such a bobbin are generally deformed due to insufficient cooling of the mold between the flanges. Flange deformation can prevent the coil wire from being wound on the bobbin. Flange deformation affects the shape of the wound coil and thereby it's electrical performance. Flange deformation can also prohibit physical placement of the bobbin in its desired position and/or orientation with respect to other electrical components. In order to maintain the coil's proper shape, the two bobbin flanges must remain flat, parallel to one another and perpendicular to the bobbin's web after forming.

SUMMARY OF THE INVENTION

A coil bobbin manufactured in accordance with the present invention maintains the proper configuration of a fine wire electrical coil having a width that is small with respect to its depth. The bobbin is constructed from two identical halves, each having one generally flat bobbin flange, one-half of a bobbin web, a latching feature and a locking feature. The mating surfaces of the two bobbin halves are defined along the bobbin web such that each half includes one complete bobbin flange. This configuration does not require the simultaneous molding of two closely spaced bobbin flanges and therefore eliminates any flange deformation associated with insufficient mold cooling. The mating surfaces are also configured such as to prevent the fine coil wire from slipping between the mating surfaces of the two bobbin halves as the coil is wound. Latching features located on one half engage latching features located on the other half such that the two halves are held together. Locking features located on each of the two halves also engage to prevent unintentional movement between the two halves prior to winding the coil on the bobbin. The latching features are configured such that winding of the coil wire about the bobbin web positively interlocks the latches, thereby preventing them from being separated after winding.

Figure 1:
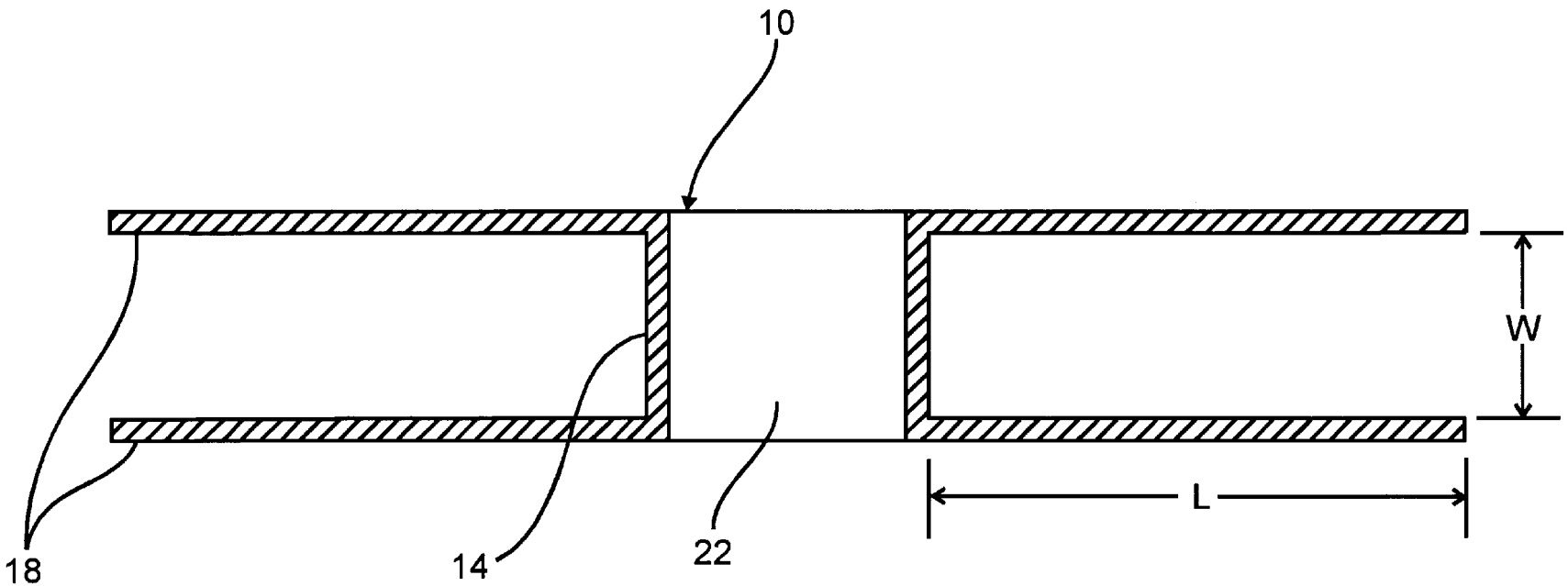
FIG. 1 is a cross-sectional view of a typical one piece bobbin of the prior art.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE DRAWINGS

FIG. 1 illustrates in cross-section a molded one-piece bobbin, generally indicated by reference numeral 10, and the features which are common to all bobbins used in coil winding. The web 14 forms the base on which the coil wire 16 (FIG. 6) of the electrical coil is to be wound and the flanges 18, each of which extends outwardly from and perpendicularly to the web 14, provide support for and maintain the proper width of the coil. The web 14 also defines the core window 22 through which a transformer core (not shown) passes. If the flanges 18 do not remain perpendicular to the web 14 and parallel to one another after molding, it can be impossible to wind the coil or the shape of the coil wound on the bobbin will be deformed. Proper cooling of the mold can be critical to the formation of the flanges 18. In FIG. 1, the letter L indicates the length of the flange 18 and the letter W indicates the width of the web 14 between the flanges 18. In many applications, the coil design requires a bobbin 10, wherein the length L of the flange 18 is long with respect to the width W of the web 14. If the dimensions of the bobbin fall within the general parameters $L/W>2$ where $W<0.375$ inch, then the mold can not be properly cooled between the flanges 18, which results in deformed flanges 18.

Figure 2:
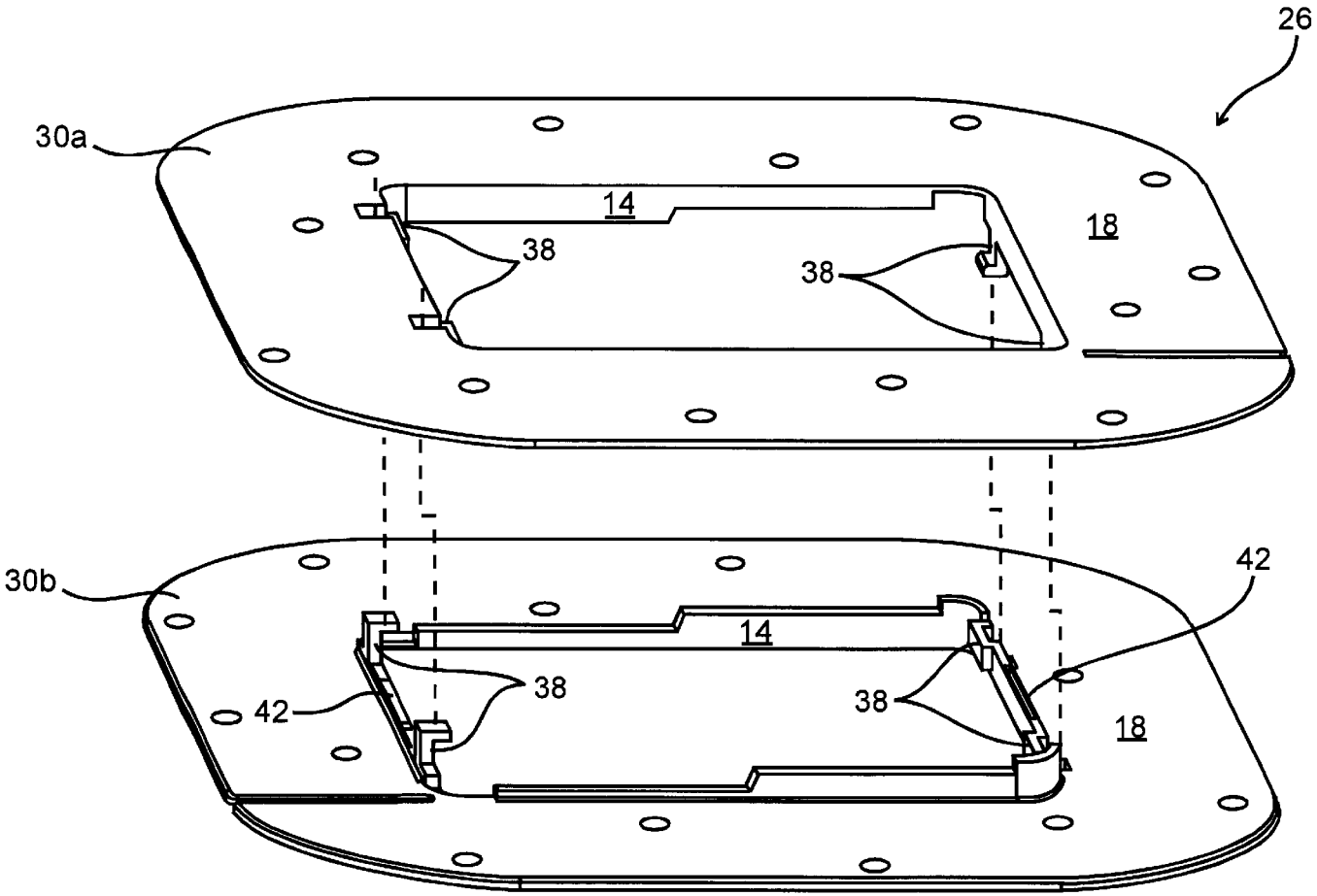
FIG. 2 is an exploded view of a coil bobbin constructed in accordance with the present invention.

FIG. 2 illustrates a bobbin manufactured in accordance with the present invention and generally indicated by reference numeral 26. For the purpose of comparison, reference numerals for those elements common to both bobbin 10 and bobbin 26 are the same. The bobbin 26 is constructed from two identical halves 30*a* and 30*b*. Each half 30*a*/30*b* includes one generally flat bobbin flange 18, a core window 22, one-half of a bobbin web 14, a latching feature 38 and a locking feature 42. Since each half 30*a*/30*b* includes one complete bobbin flange 18, the mold cooling problem described above is eliminated.

Figure 3:
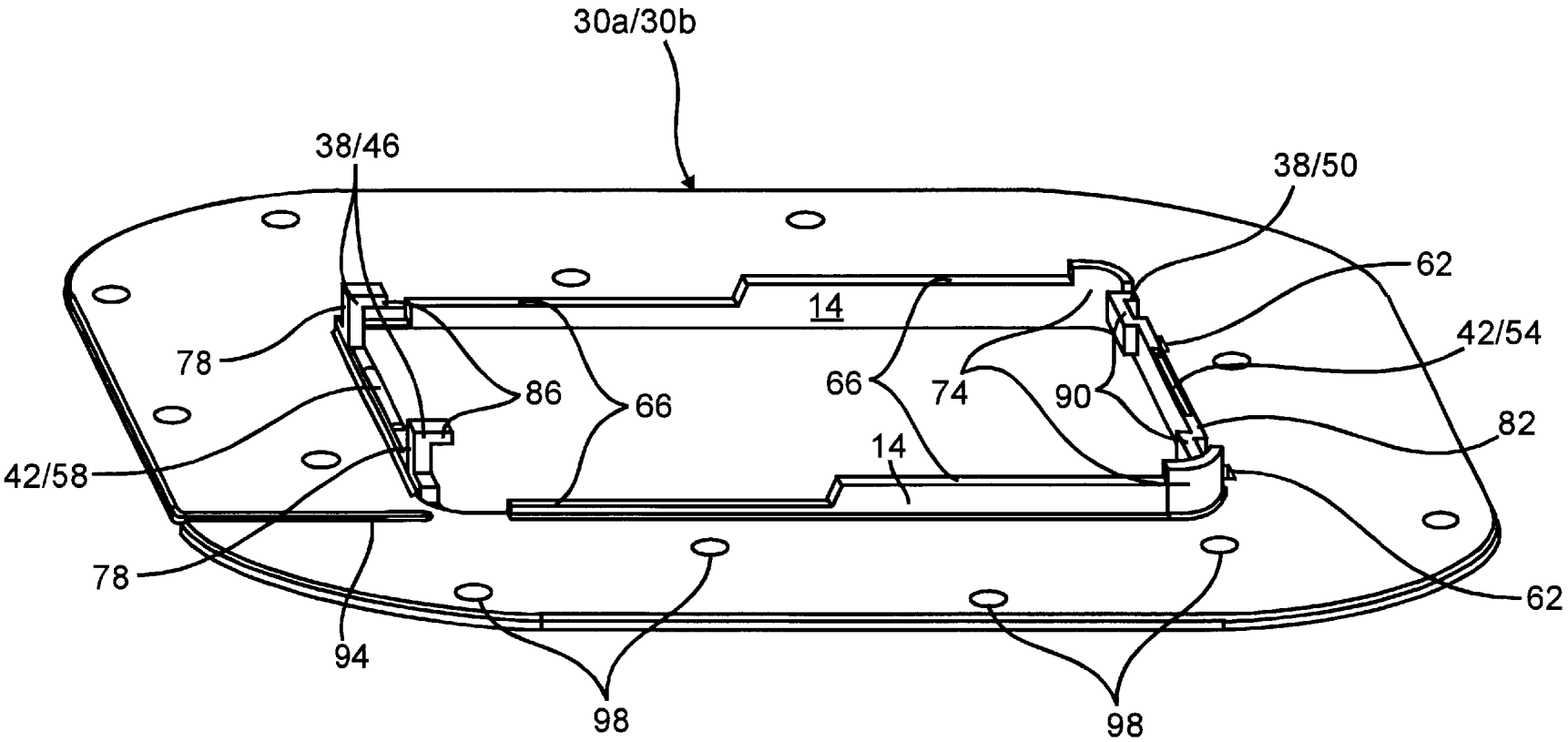
FIG. 3 illustrates one of the coil bobbin halves of FIG. 2.

FIG. 3 illustrates one of the bobbin halves 30*a*/30*b* such that the latching feature 38, locking feature 42, construction of the web 14 and other features can be seen in greater detail. The core window 22 is centrally located in the bobbin flange 18. The web 14 extends outwardly from and generally perpendicular to the flange 18 along the perimeter of the core window 22. The latching feature 38 and locking feature 42 are integrally formed from the web 14. In the illustrated embodiment, the latching feature 38 includes at least one each of a hook 46 and an eye 50 and the locking feature 42 includes at least one each of a groove 54 and a rib 58. Associated with each eye 50 is a slot 62 defined in the generally flat flange 18 immediately adjacent the eye 50. The hook 46, eye 50, groove 54 and rib 58 are positioned in the bobbin half 30*a*/30*b* such that when two bobbin halves 30*a* and 30*b* are positioned for assembly, each hook 46 of bobbin half 30*a* or 30*b* is associated with an eye 50 of the other bobbin half 30*a* or 30*b* and each groove 54 of one bobbin half 30*a* or 30*b* is associated with a rib 58 of the other bobbin half 30*a* or 30*b*. The mating surfaces 66 of the bobbin halves 30*a*/30*b* are defined by the web 14. The mating surfaces 66 are configured to permit a limited amount of longitudinal displacement between the two bobbin halves 30*a* and 30*b* during assembly. This limited amount of longitudinal displacement between the bobbin halves 30*a* and 30*b* is required for proper engagement of the latching features 38 and locking features 42. The mating surfaces 66 are also configured such that after the bobbin 26 is assembled, the fine coil wire 16 (FIG. 6) wound on the bobbin 26 can not be drawn into any gaps between the mating surfaces 66 of the web 14. This is accomplished by providing web offsets 70 in each bobbin half 30*a*/30*b*. The web offsets 70 work in conjunction with integrally formed pillars 74 dimensioned to extend completely across the bobbin web 14 at the comers of a rectangular bobbin 26. In a circular shaped bobbin (not shown), the web offsets 70 alone can be arranged to prevent the fine coil wire 16 from being pulled between the mating surfaces 66 of the bobbin halves 30*a*/30*b*. A back surface 78 of the hook 46 becomes flush with an outside wall 82 of the web 14 and a latching end 86 of the hook 46 slidingly engages a latching edge 90 of the eye 50 when the two bobbin halves 30*a* and 30*b* are fully assembled. Each bobbin flange 18 also includes a coil wire slot 94 and a number of apertures 98, which permit varnish or other electrically insulating or potting type material (not shown) to easily enter the bobbin 26.

Figure 4:
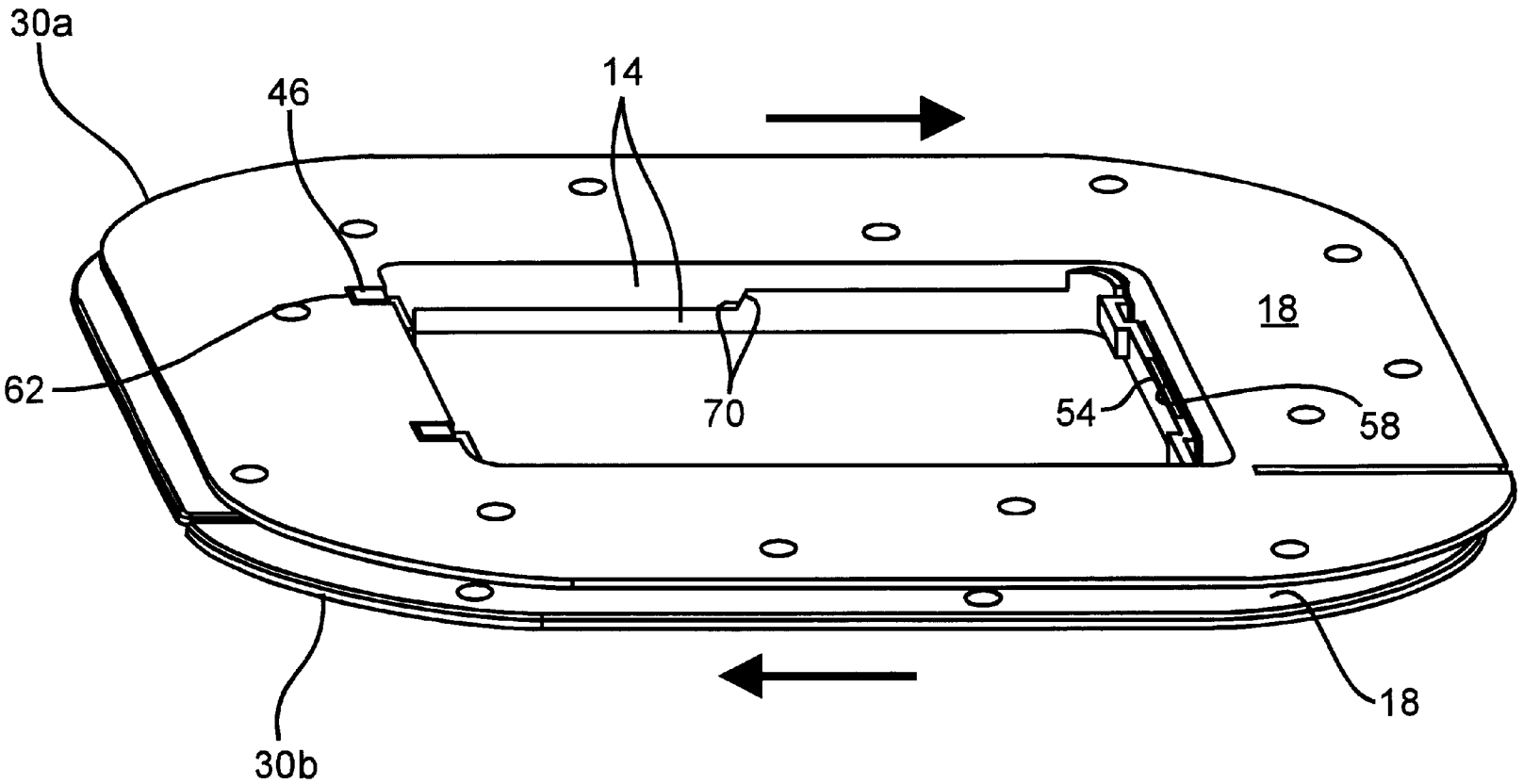
FIG. 4 illustrates the coil bobbin halves of FIG. 2 in a pre-assembly position.

Referring now to FIG. 4, the two bobbin halves 30*a*/30*b* are shown in a pre-assembly position. In the pre-assembly position the two bobbin halves 30*a* and 30*b* are slightly offset as indicated by the arrows and in opposed complementary relationship such that the bobbin flanges 18 of each bobbin half 30*a*/30*b* are separated by the bobbin web 14. The mating surfaces 66 and web offsets 70 of each bobbin half 30*a* and 30*b* are in contact with one another and the hooks 46 of one bobbin half 30*a* or 30*b* are received in the slots 62 of the other bobbin half 30*a* or 30*b*. In this offset pre-assembly position, the rib 58 of one bobbin half 30*a* or 30*b* is parallel to and adjacent its associated groove 54 of the other bobbin half 30*a* or 30*b*.

Figure 5:
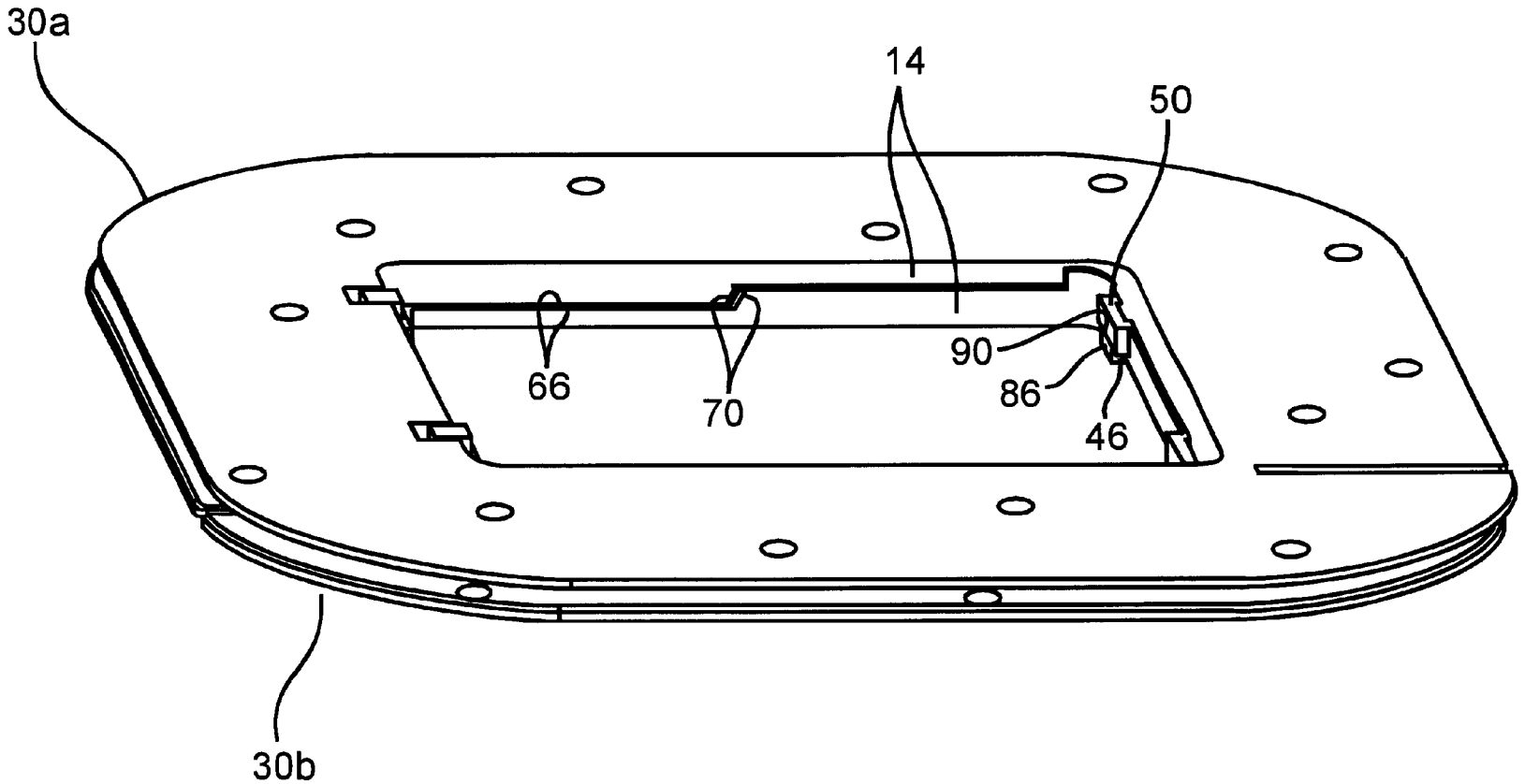
FIG. 5 illustrates the coil bobbin halves of FIG. 2 in the fully assembled position.
Figure 6:
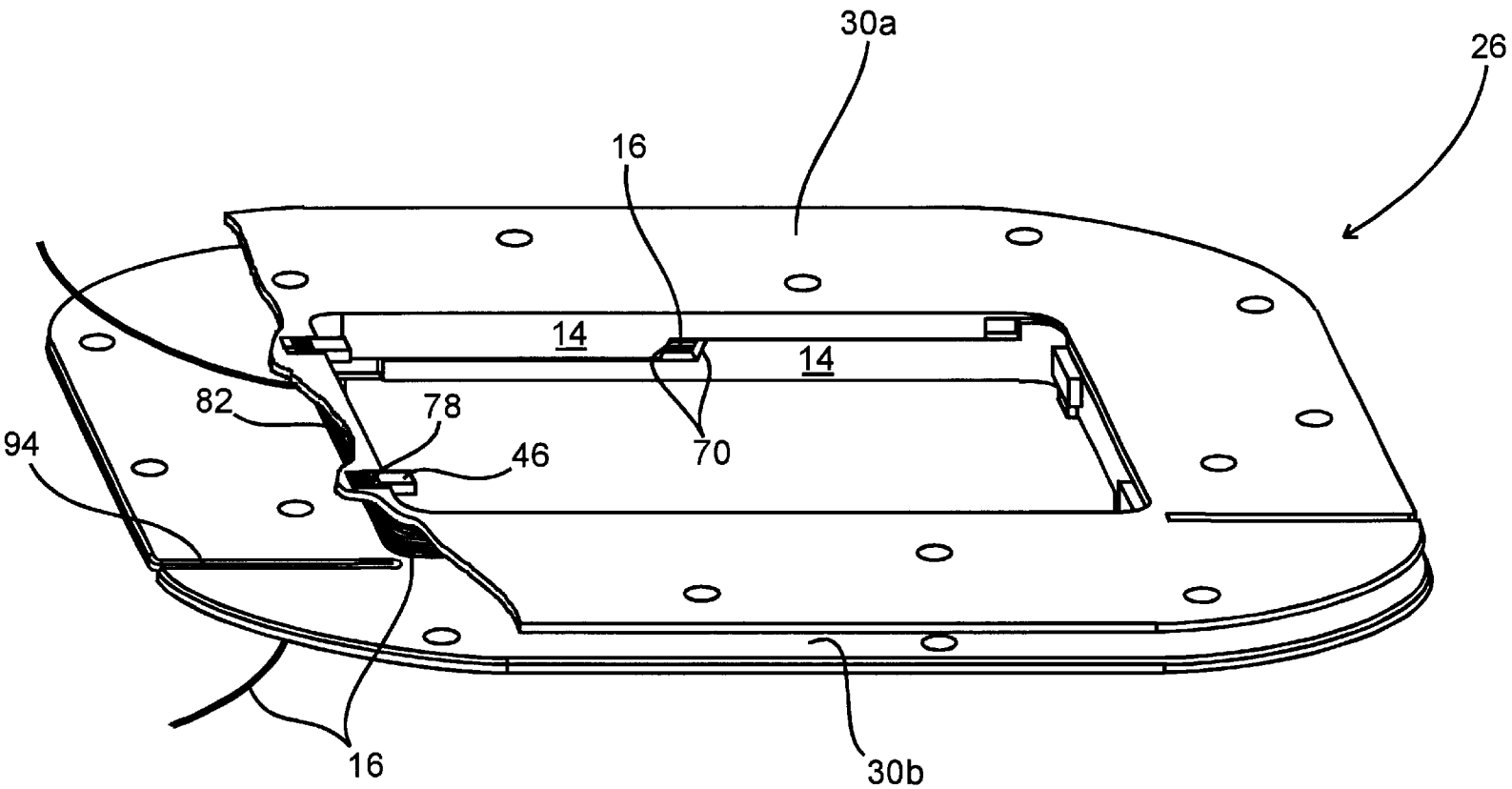
FIG. 6 illustrates an assembled coil bobbin with a section removed for illustrating how the coil wire of the electrical coil is tightly wound on the bobbin and prevents slidable displacement between the two bobbin halves.

Referring now to FIG. 5, the two bobbin halves 30*a* and 30*b* are shown fully assembled. When assembled, the bobbin halves 30*a* and 30*b* are in alignment such that the latching end 86 of hooks 46 of one bobbin half 30*a* or 30*b* will slidingly engage the latching edges 90 of eyes 50 of the other bobbin half 30*a* or 30*b*. This engagement prevents the two bobbin halves 30*a* and 30*b* from separating. Simultaneously, the rib 58 of one bobbin half 30*a* or 30*b* is received in its associated groove 54 in the other bobbin half 30*a* or 30*b*, preventing slidable movement of the two bobbin halves 30*a*/30*b* back into the pre-assembly position. During the coil winding process, the coil wire 16 tightly engages both the outside wall 82 of the web 14 and the back surface 78 of the hooks 46, as shown in FIG. 6, preventing any separation of the two bobbin halves 30*a* and 30*b*. In the assembled position, the offsets 70 of the web 14 are spaced apart slightly while the mating surfaces 66 remain in contact with one another.

We claim:

1. A bobbin for an electrical coil, said bobbin comprising:

first and second bobbin halves, each being identical in shape and defining a generally flat bobbin flange, a core window generally at the center of said bobbin flange and one-half of a bobbin web extending outwardly from and generally perpendicularly to said bobbin flange along the perimeter of said core window, said first and second bobbin halves forming a complete bobbin when assembled in opposed complementary relationship such that said web halves of said first and second bobbin halves are in a juxtaposed position and said bobbin flanges are generally parallel to one another and spaced apart by said bobbin web.

2. The bobbin of claim 1 wherein each said bobbin web half defines latching features for holding said first and second bobbin halves together.

3. The bobbin of claim 2 wherein said latching features include at least one hook and at least one eye, said at least one hook and said at least one eye being arranged on said bobbin web half such as to be slidingly interlocked when said first and second bobbin halves are in opposed complementary relationship.

4. The bobbin of claim 3 wherein each said bobbin web half further defines locking features for preventing said at least one hook and said at least one eye of said latching features from being unintentionally slidably displaced after being slidingly interlocked.

5. The bobbin of claim 4 wherein said locking features include a rib and a groove arranged on said web half of each of said first and second bobbin halves such as to be positively interlocked when said at least one hook and said at least one eye of said latching features are slidingly interlocked.

6. The bobbin of claim 3 wherein a back surface of said at least one hook of one of said first or second bobbin halves becomes flush with an outside surface of said web half of the other of said first or second bobbin halves when said at least one hook and said at least one eye are interlocked, thereby providing a generally flat surface for receiving the electrical coil being tightly wound on said outside surface of said web and said back surface of said hook permanently prevents any slidable displacement between said at least one hook and said at least one eye.

7. The bobbin of claim 3 wherein each said bobbin web half further defines a mating surface, said mating surface being configured to allow a predetermined amount of longitudinal movement between said first and second bobbin halves for interlocking said latching features.

8. The bobbin of claim 7 wherein said mating surfaces are further configured to prohibit the coil wire from being pulled between said mating surfaces during the winding process.

9. The bobbin of claim 1 wherein each of said first and second bobbin halves defines a wire slot in said bobbin flange, said wire slot of one of said first or second bobbin halves receives the leading end of the coil wire at the beginning of the coil winding process and said wire slot of the other of said first or second bobbin halves receives the trailing end of the coil wire at the end of the coil winding process.

10. The bobbin of claim 1 wherein each of said first and second bobbin halves defines a plurality of apertures in said flange for allowing an insulating fluid or a potting fluid to easily penetrate the wound coil wire between said bobbin flanges.

11. A bobbin for an electrical coil, said bobbin comprising:

two identical bobbin halves, each having one generally flat flange, said flange defining a centrally located core window and a web portion extending outwardly from and generally perpendicularly to said flange along a perimeter of said core window and terminating at a mating surface, said two identical bobbin halves forming one complete bobbin when assembled in opposed complementary relationship such that said mating surfaces are in a juxtaposed position and said flanges are generally parallel to one another and spaced apart by said web portions.

12. The bobbin of claim 11 wherein said mating surfaces are further configured to prohibit the coil wire from being pulled between said mating surfaces.

13. The bobbin of claim 11 wherein each said web portion defines latching features for holding said first and second bobbin halves together.

14. The bobbin of claim 13 wherein said mating surfaces are configured to allow a predetermined amount of longitudinal movement between said two identical bobbin halves for interlocking said latching features.

15. The bobbin of claim 13 wherein said latching features include at least one hook and at least one eye, said at least one hook and said at least one eye being arranged along said web portion of each of said two identical bobbin halves such as to be slidingly interlocked when said web portions of said two identical bobbin halves are in opposed complementary relationship.

16. The bobbin of claim 15 wherein each said web portion further defines locking features for preventing said at least one hook and said at least one eye of said latching features from being unintentionally slidably displaced after being slidingly interlocked.

17. The bobbin of claim 15 wherein said locking features include a rib and a groove arranged along said mating surface of each of said two identical bobbin halves such as to be positively interlocked when said at least one hook and said at least one eye are slidingly interlocked.

18. The bobbin of claim 15 wherein a back surface of said at least one hook of one of said two identical bobbin halves becomes flush with an outside surface of said web portion of the other of said two identical bobbin halves when said at least one hook and said at least one eye are interlocked, thereby providing a generally flat surface for receiving the electrical coil being tightly wound on said outside surface of said web portions and said back surface of said at least one hook permanently prevents any slidable displacement between said at least one hook and said at least one eye.

19. The bobbin of claim 11 wherein each of said two identical bobbin halves defines a wire slot in said flange, said wire slot of one of said two identical bobbin halves receives the leading end of the coil wire at the beginning of the coil winding process and said wire slot of the other of said two identical bobbin halves receives the trailing end of the coil wire at the end of the coil winding process.

20. The bobbin of claim 11 wherein each of said two identical bobbin halves defines a plurality of apertures in said flange for allowing an insulating fluid or a potting fluid to easily penetrate the wound coil wire between said bobbin flanges.

* * * * *